US012729466B2

(12) United States Patent
Qiu et al.

(10) Patent No.: US 12,729,466 B2
(45) Date of Patent: Sep. 8, 2026

(54) CONVOLUTE KNIT SLEEVE AND METHOD OF CONSTRUCTION THEREOF

(71) Applicant: SYSTEMS PROTECTION GROUP US LLC, Northville, MI (US)

(72) Inventors: Xiaodan Qiu, Northville, MI (US); Axell Bailon, Northville, MI (US)

(73) Assignee: Systes Protection Group US LLC, Northville, MI (US)

( * ) Notice: Subject to any disclaimer, the term of this patent is extended or adjusted under 35 U.S.C. 154(b) by 0 days.

(21) Appl. No.: 19/408,235

(22) Filed: Dec. 3, 2025

(65) Prior Publication Data

US 2026/0160001 A1 Jun. 11, 2026

Related U.S. Application Data

(60) Provisional application No. 63/728,372, filed on Dec. 5, 2024.

(51) Int. Cl.
*D04B 1/22* (2006.01)

(52) U.S. Cl.
CPC ..... *D04B 1/225* (2013.01)

(58) Field of Classification Search
CPC ..... D04B 1/225; D04B 1/22; D04B 1/102; D04B 7/32; D04B 9/44; D04B 21/205; F16L 27/11
USPC ..... 66/170, 169 R, 200
See application file for complete search history.

(56) References Cited

U.S. PATENT DOCUMENTS 2,222,522 A * 11/1940 Webster ..... D04B 1/225 66/190
2,836,181 A * 5/1958 Tapp ..... B29C 53/30 623/1.53
2,881,603 A 4/1959 Vendetti
3,044,497 A * 7/1962 Rebut ..... B29C 53/30 138/123
4,124,183 A 11/1978 Herrig et al.
(Continued)

FOREIGN PATENT DOCUMENTS

EP 2312192 A1 4/2011
EP 3593023 B1 * 6/2022 ..... D04C 1/02
EP 3132076 B1 3/2023

OTHER PUBLICATIONS

International Search Report and Written Opinion for International Application No. PCT/US2025/058231 mailed Apr. 2, 2026 (15 pages).

*Primary Examiner* — Danny Worrell
(74) *Attorney, Agent, or Firm* — John D. Wright; Dickinson Wright PLLC

(57) ABSTRACT

A convolute protective textile sleeve having a flexible, tubular wall of knit yarn extending lengthwise along a longitudinal axis between opposite ends includes a plurality of courses extending circumferentially about the longitudinal axis and a plurality of wales extending lengthwise from one of the opposite ends to the other of the opposite ends in generally parallel relation with the longitudinal axis. The plurality of courses include first courses forming annular crests of the tubular wall having a first diameter and second courses forming annular valleys of the tubular wall having a second diameter less than the first diameter. The first courses and the second courses alternate with one another along the longitudinal axis to provide the tubular wall with a convolute contour.

20 Claims, 4 Drawing Sheets

(56) References Cited

U.S. PATENT DOCUMENTS

| | | | | |
|---|---|---|---|---|
| 6,230,748 | B1 * | 5/2001 | Krawietz | F16L 27/111 138/123 |
| 6,711,920 | B2 | 3/2004 | Akers et al. | |
| 7,044,785 | B2 | 5/2006 | Harwath et al. | |
| 7,690,225 | B2 | 4/2010 | Relats et al. | |
| 10,208,410 | B2 * | 2/2019 | Gao | D04C 1/08 |
| 10,711,378 | B2 * | 7/2020 | Knudson | D04B 21/205 |
| 10,982,355 | B2 * | 4/2021 | Zhang | D04B 1/225 |
| 11,920,266 | B2 | 3/2024 | Qiu | |
| 2003/0089971 | A1 * | 5/2003 | Akers | F16L 57/04 257/678 |
| 2014/0260436 | A1 * | 9/2014 | Putta | F16L 57/06 66/170 |
| 2017/0137978 | A1 * | 5/2017 | Gao | D04C 1/08 |
| 2018/0016717 | A1 * | 1/2018 | Knudson | D04B 21/14 |
| 2022/0290339 | A1 * | 9/2022 | Qiu | D03D 3/02 |

* cited by examiner

CONVOLUTE KNIT SLEEVE AND METHOD OF CONSTRUCTION THEREOF

CROSS-REFERENCE TO RELATED APPLICATIONS

This application claims the benefit of U.S. Provisional Application Ser. No. 63/728,372, filed Dec. 5, 2024, which is incorporated herein by reference in its entirety.

BACKGROUND OF THE INVENTION

1. Technical Field

This invention relates generally to textile sleeves for protecting elongate members, and more particularly to knit, convolute textile sleeves.

2. Related Art

Textile sleeves are known for use to provide protection to internally contained elongate members, such as wire(s), wire harnesses, fluid or gas conveying tubes, or cables, for example. It is further known to knit tubular textile sleeves for protecting elongate members contained therein. Modern vehicle and aerospace applications for such sleeves are requiring greater protection to the elongate members, such as against increased environmental temperatures, increased resistance to abrasion, increased acoustic performance via resistance to causing noise, increased impact resistance, and are further requiring enhanced flexibility due to having to be routed over tight meandering paths. While being routed over a meandering path, it has been found to be important to resist kinking a wall of the sleeve. Kinking the sleeve wall can potentially damage and/or reduce the functional performance of elongate member(s) being protected by the sleeve. These desired increased functional requirements require the sleeves to pass increasingly stringent test parameters, such as exposure to increased temperatures, exposure to specifically defined abrasion/acoustic test specifications, and exposure to flex/anti-kink tests. Meanwhile, it is important to have the sleeve be conformable about the elongate member during assembly and while in use, as well as being impact resistant, able to maintain a tubular configuration, economical in manufacture and in assembly/use, while having a long and useful life.

A knit sleeve constructed in accordance with this invention is able to meet the increasingly demanding temperature, impact, acoustic and abrasion resistant test parameters, as well as demonstrate greatly enhanced conformability and flexibility without kinking, with other benefits being readily recognized by those possessing ordinary skill in the art.

SUMMARY OF THE INVENTION

A convolute protective textile sleeve having a flexible, tubular wall of knit yarn extending lengthwise along a longitudinal axis between opposite ends includes a plurality of courses extending circumferentially about the longitudinal axis and a plurality of wales extending lengthwise from one of the opposite ends to the other of the opposite ends in generally parallel relation with the longitudinal axis. The plurality of courses include first courses forming annular crests of the tubular wall having a first diameter and second courses forming annular valleys of the tubular wall having a second diameter less than the first diameter. The first courses and the second courses alternate with one another along the longitudinal axis to provide the tubular wall with a convolute contour.

In accordance with another aspect of the disclosure, the first courses are formed of front knit stitches and the second courses are formed of back knit stitches.

In accordance with another aspect of the disclosure, an axially extending length of each crest is defined by a number of successive axially adjacent interlinked courses of front knit stitches within the first courses and an axially extending length of each valley is defined by a number of successive axially adjacent interlinked courses of back knit stitches within the second courses.

In accordance with another aspect of the disclosure, the wall is knitted as a circumferentially continuous and seamless wall.

In accordance with another aspect of the disclosure, the wall is knitted as a wrappable wall having opposite lengthwise extending edges extending generally parallel to the longitudinal axis, with the edges being wrapped into overlapping relation with one another to form the wall having a tubular configuration.

In accordance with another aspect of the disclosure, the wrappable wall includes heat-set yarn automatically biasing and maintaining the opposite edges in wrapped, overlapping relation with one another.

In accordance with another aspect of the disclosure, the knit yarn includes monofilament yarn.

In accordance with another aspect of the disclosure, the knit yarn includes multifilament yarn, wherein the knit yarn can be provided entirely of multifilament yarn.

In accordance with another aspect of the disclosure, the knit yarn includes fire-resistant yarn.

In accordance with another aspect of the disclosure, a method of constructing a convolute textile sleeve includes knitting yarn to form a flexible wall including a plurality of wales extending generally parallel to a longitudinal axis between opposite ends of the flexible wall and a plurality of courses extending generally transverse to the longitudinal axis. Further, knitting the plurality of courses including first courses and second courses alternating with one another along the longitudinal axis. Further yet, knitting the first courses as annular crests and knitting the second courses as annular valleys.

In accordance with another aspect of the disclosure, the method can further include knitting the flexible wall as a circumferentially continuous, seamless wall.

In accordance with another aspect of the disclosure, the method can further include knitting the flexible wall having opposite edges extending lengthwise between the opposite ends, with the opposite edges being configured to be brought into overlapping relation one another.

In accordance with another aspect of the disclosure, the method can further include heat-setting the flexible wall to impart a bias on the wall to automatically bias the opposite edges into overlapping relation with one another.

In accordance with another aspect of the disclosure, the method can further include controlling the axially extending length of the first courses by controlling the number of successive axially adjacent interlinked front knit stitches within the first courses and controlling the axially extending length of the second courses by controlling the number of successive axially adjacent interlinked back knit stitches within the second courses.

In accordance with another aspect of the disclosure, the method can further include knitting the yarn including multifilament yarn.

In accordance with another aspect of the disclosure, the method can further include knitting the yarn entirely of multifilament yarn.

In accordance with another aspect of the disclosure, the method can further include knitting the yarn including monofilament yarn.

In accordance with another aspect of the disclosure, the method can further include knitting the yarn including fire-resistant yarn.

BRIEF DESCRIPTION OF THE DRAWINGS

These and other aspects, features and advantages of the disclosure will become readily apparent to those skilled in the art in view of the following detailed description of the presently preferred embodiments and best mode, appended claims, and accompanying drawings, in which:

DETAILED DESCRIPTION OF PREFERRED EMBODIMENTS

Figure 1A:
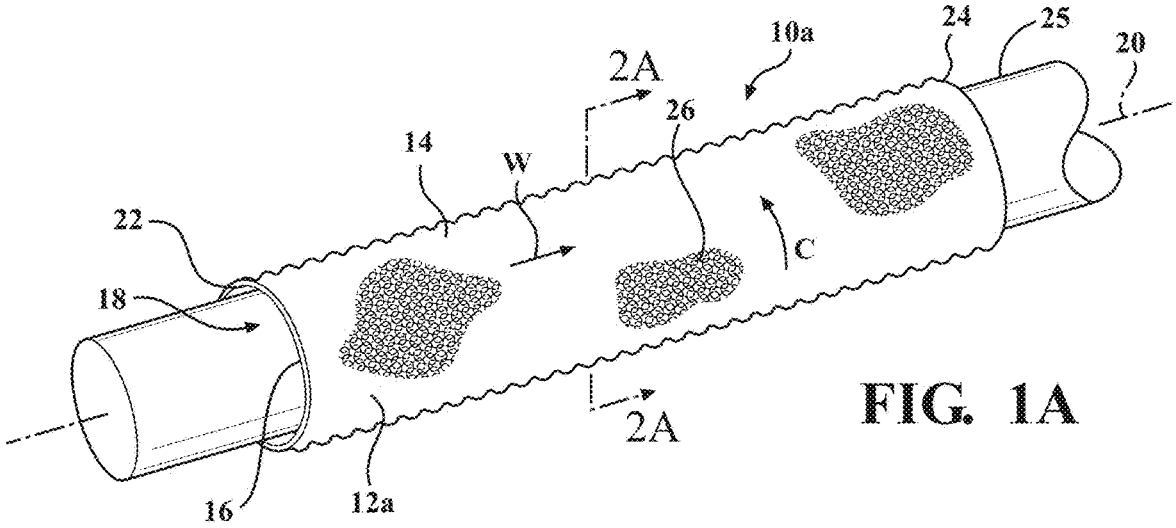
FIG. 1A is a schematic perspective view of a knitted protective textile sleeve constructed in accordance with one aspect of the disclosure shown protecting an elongate member extending therethrough.
Figure 1B:
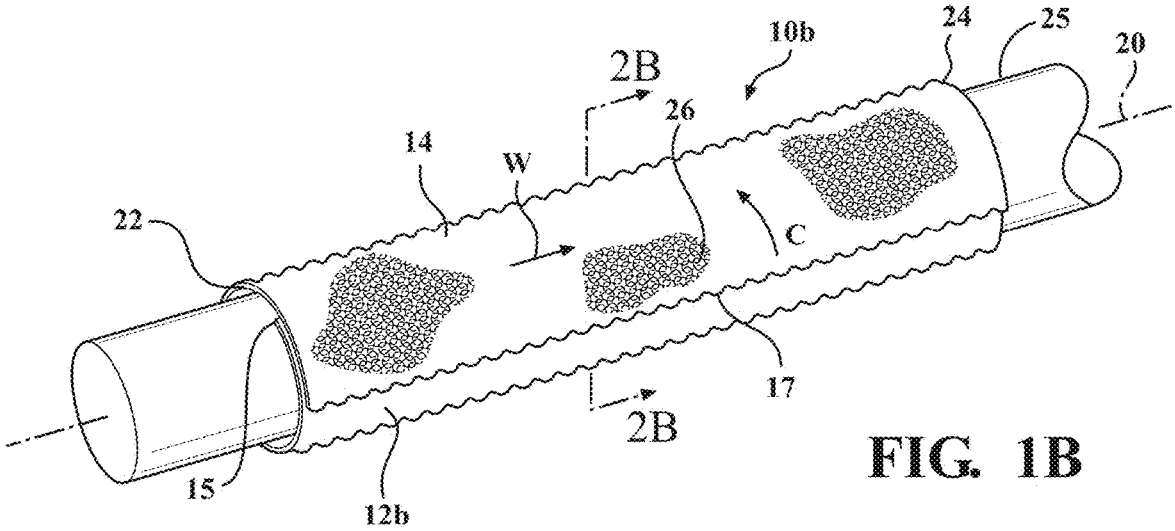
FIG. 1B is a schematic perspective view of a knitted protective textile sleeve constructed in accordance with another aspect of the disclosure shown protecting an elongate member extending therethrough.
Figure 2A:
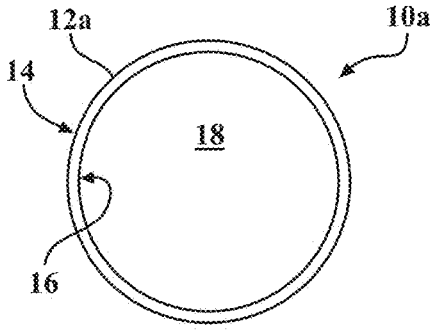
FIG. 2A is a schematic cross-sectional view of the knitted protective textile sleeve of FIG. 1A taken generally along the line 2A-2A.
Figure 2B:
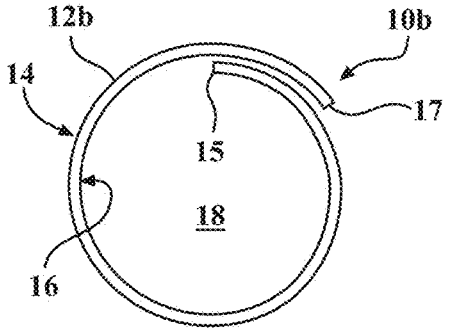
FIG. 2B is a schematic cross-sectional view of the knitted protective textile sleeve of FIG. 1B taken generally along the line 2B-2B.
Figure 3:
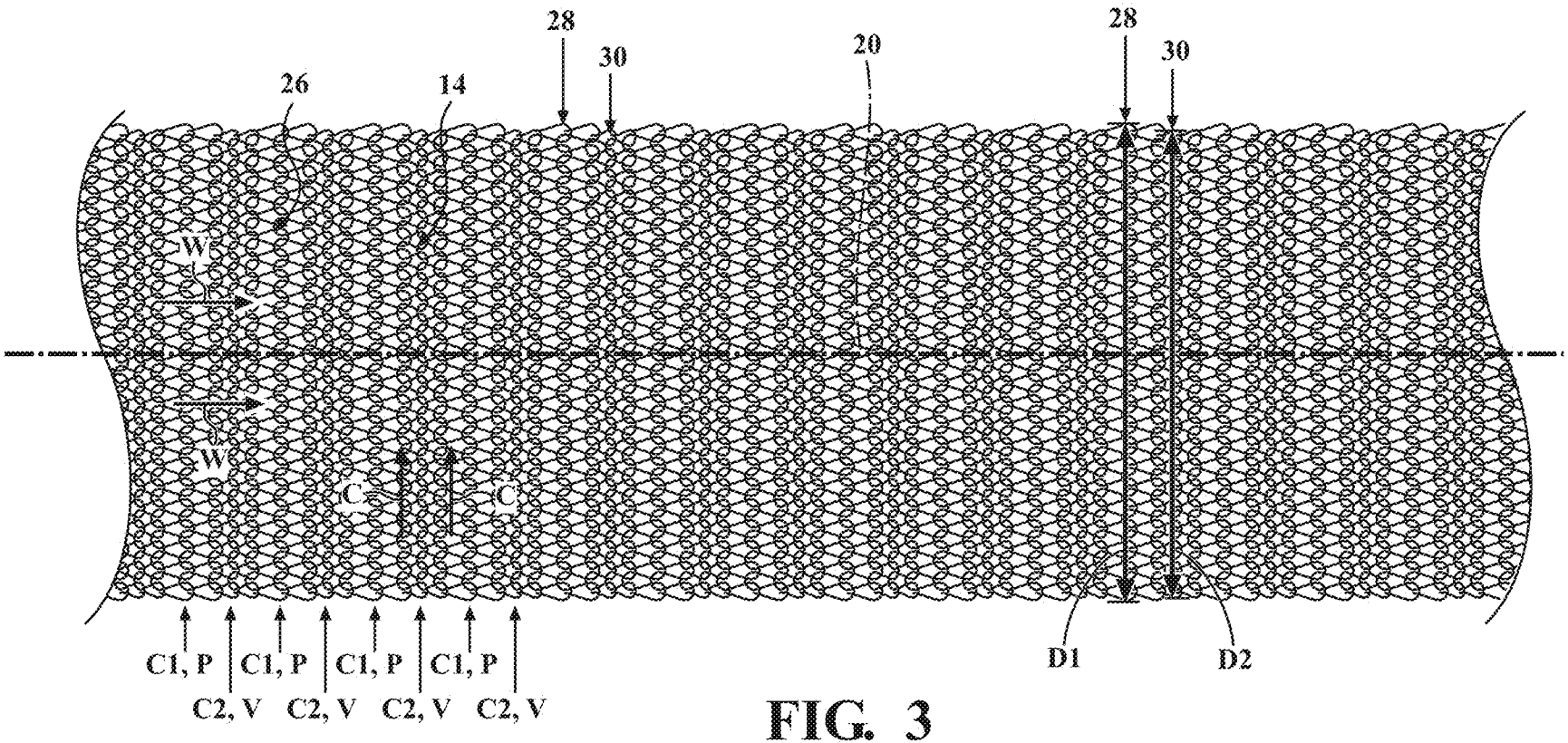
FIG. 3 is a fragmentary side plan view of a knitted wall of the knitted protective textile sleeve of FIGS. 1A and 1B.

Referring in more detail to the drawings, FIGS. 1A and 1B illustrate knitted tubular textile sleeves 10*a*, 10*b*, respectively, constructed in accordance with the disclosure. The sleeves 10*a*, 10*b* have a knitted flexible tubular wall 12*a*, 12*b* that is abrasion resistant, thermally protective, impact resistant, and acoustically protective. The wall 12*a* can be knit in seamless fashion, having a circumferentially continuous, uninterrupted outer surface 14 (FIG. 2A) having an inner surface 16 that bounds and defines an inner tubular cavity 18 that extends axially along a central longitudinal axis 20 between opposite ends 22, 24 of the sleeve 10*a*, or, as shown in another embodiment in FIG. 2B, the sleeve 10*b* can be formed with the wall 12*b* having opposite lengthwise extending edges 15, 17 extending lengthwise in generally parallel relation with the central longitudinal axis 20 from one end 22 to the opposite end 24, with the opposite edges 15, 17 configured to be wrapped into overlapping relation with one another to bound and define a cavity 18. The cavity 18 is sized for receipt of an elongate member 25 to be protected, such as a wire harness, fluid or gas conveying conduit, cable or the like, therethrough. The discussion hereafter for wall 12*a* also applies to wall 12*b*, unless expressly stated otherwise. Wall 12*a* includes knit yarn(s) 26 knitted over a plurality of courses C extending circumferentially about the longitudinal axis 20 and a plurality of wales W extending lengthwise from one of the opposite ends 22 to the other of the opposite ends 24 in generally parallel relation with the longitudinal axis 20. As best shown in FIG. 3, the plurality of courses C include a plurality of first courses C1 forming annular crests, also referred to as peaks P, of the tubular wall 12*a*, with the peaks P having a first diameter D1, and a plurality of second courses C2 forming annular troughs, also referred to as valleys V, of the tubular wall 12*a* having a second diameter D2 that is less than the first diameter D1. The first courses C1 and the second courses C2 alternate with one another along the longitudinal axis 20 to provide the tubular wall 12*a* with a convolute contour, thereby enhancing the flexibility and kink-resistance of the wall 12*a* via the valleys V, and enhancing the impact resistance and kink-resistance of the wall 12*a* via the peaks P.

Figure 4A:
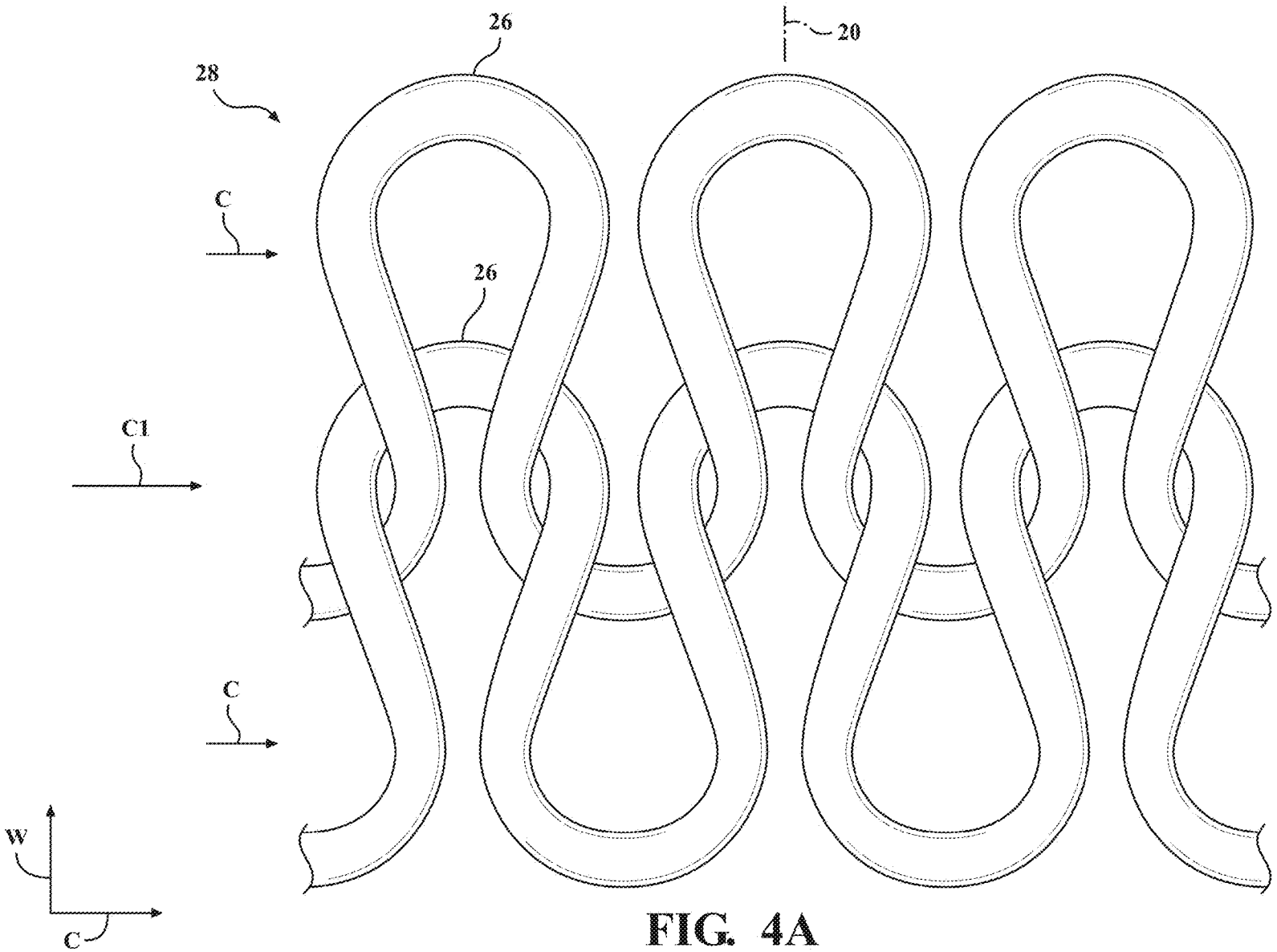
FIG. 4A is a non-limiting schematic knit stitch used to form first courses of the knitted walls of the knitted protective textile sleeves of FIGS. 1A and 1B.
Figure 4B:
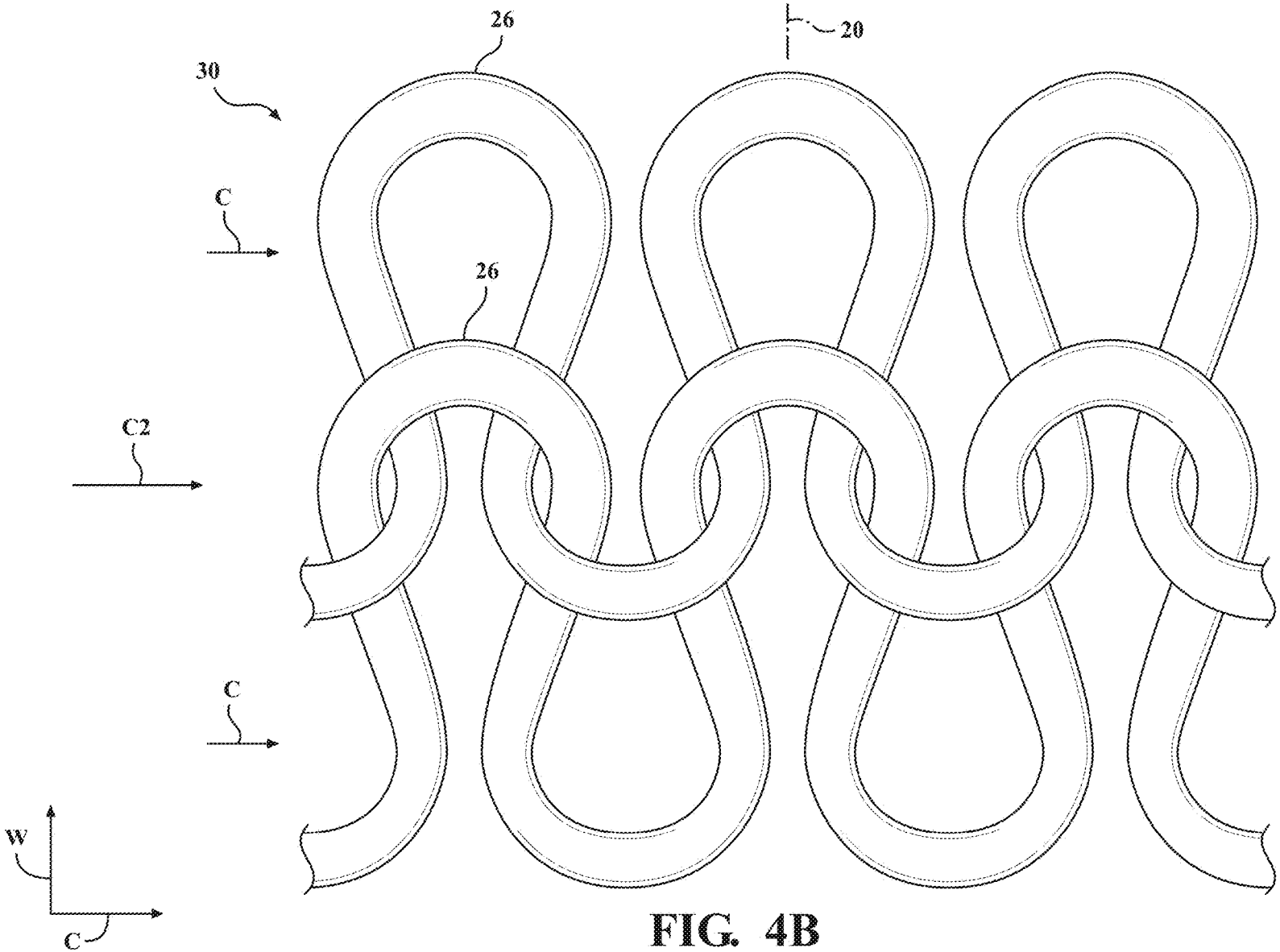
FIG. 4B is a non-limiting schematic knit stitch used to form second courses of the knitted walls of the knitted protective textile sleeves of FIGS. 1A and 1B.

The first courses C1, forming the peaks P, are formed by front knit stitches 28 (FIG. 4A) and the second courses C2, forming the valleys V, are formed by back knit stitches 30 (FIG. 4B). An axially extending length of each peak P is provided by controlling the number of successive axially adjacent interlinked front knit stitches 28 within each of the first courses C1 and an axially extending length of each valley V is provided by controlling the number of successive axially adjacent interlinked back knit stitches within each of the second courses C2. Accordingly, the axially extending lengths of the peaks P and valleys V can be customized, as desired, wherein each peak P can be formed having the same axially extending length and each valley V can be formed having the same axially extending length, or, any one or more of the peaks P can be formed having different axially extending lengths and any one or more of the valleys V can be formed having different axially extending lengths.

The wall 12*a* can be knit with types of yarn(s) 26 as desired, whether monofilaments and/or multifilaments, as discussed in more detail hereafter, which results in an ability to provide increased protection against abrasion, thermal effects, and impact forces, as well as providing a greatly enhance noise absorption capacity without need for additional layers.

The wall 12*a* can be constructed having any suitable length and inner diameter. With the wall 12*a* providing multiple facets of increased protection, including abrasion resistance, thermal protection, impact resistance, noise absorption, as well as enhanced flexibility and kink-resistance, the sleeve 10*a* is made cost effective given its ability to provide full protection to the elongate member 25 by itself without need additional wall layers or a secondary coating materials beyond that provided by the single layer wall 12*a*. The wall 12*a* can be knit entirely from multifilament yarn, including fire-resistant multifilament yarn, such as mineral yarn, including fiberglass, ceramic, basalt, silica, or nomex, by way of example and without limitation. Otherwise, it is contemplated that both multifilament and polymeric monofilament yarn can be used, with the polymeric monofilament enhancing abrasion resistance and hoop strength of the wall 12*a*. It is contemplated that to maximize abrasion resistance, the peaks P can be formed of the polymeric monofilament yarns, while the valleys V can be formed of the more flexible multifilament yarns to maximize thermal protection, impact resistance, noise absorption, as well as enhanced flexibility and kink-resistance. Accordingly, the peaks P can be formed solely or substantially (meaning about 75-99% by weight) of monofilaments yarns, while the valleys V can be formed solely or substantially (meaning about 75-99% by weight) of multifilament yarns.

If the wall 12*b* is formed as a wrappable sleeve 10*b*, heat-settable polymeric yarn, whether monofilament or multifilament, can be included. In particular, heat-settable yarn can be included in the peaks P and/or valleys V, such that upon wrapping the opposite edges 15, 17 into overlapping relation with one another, the wall 12*b* can be heated in a suitable heat-treatment process to impart a permanent heat-set into the heat-settable yarn, thereby causing the heat-set yarn to impart a permanent bias on the wall 12*b* to maintain the wall 12*b* in its wrapped, tubular configuration. Of course, a suitable bias can be applied to the edges 15, 17 to open the wall 12*b* for insertion or removal of the elongate member 25. The heat-settable yarn can be can be provided as polyethylene, polypropylene, or polyphenylene sulfide material to provide excellent balance of properties, including high temperature resistance, chemical resistance, flowability, dimensional stability and electrical characteristics.

In accordance with another aspect of the disclosure, a method of constructing a convolute textile sleeve 10*a*, 10*b* is provided. The method includes knitting yarn 26 to form a flexible wall 12*a*, 12*b* including a plurality of wales W extending generally parallel to a longitudinal axis 20 between opposite ends 22, 24 of the flexible wall 12*a*, 12*b* and a plurality of courses C extending generally transverse to the longitudinal axis 20. Further, knitting the plurality of courses C including a plurality of first courses C1 and a plurality of second courses C2, with the first courses C1 and second courses C2 alternating with one another along the longitudinal axis 20, and knitting the first courses C1 as annular crests extending radially outwardly away from the longitudinal axis 20, also referred to as peaks P, and knitting the second courses C2 as annular valleys V extending radially inwardly toward the longitudinal axis 20.

The method can further include weaving the wall 12*a* being circumferentially continuous and seamless.

The method can further include weaving the wall 12*b* having opposite lengthwise extending edges 15, 17 extending generally parallel to the longitudinal axis 20, with the edges 15, 17 being configured to be wrapped into overlapping relation with one another.

The method can further include heat-setting at least some of the yarn 26 to bias and maintain the opposite edges 15, 17 in wrapped, overlapping relation with one another.

The method can further include controlling the axially extending length of individual ones of the crests formed by the first courses C1 by controlling the number of successive axially adjacent interlinked front knit stitches 28 within the first courses C1 and controlling the axially extending length of individual ones of the valleys formed by the second courses C2 by controlling the number of successive axially adjacent interlinked back knit stitches 30 within the second courses C2.

The method can further include knitting the yarn 26 including multifilament yarn.

The method can further include knitting the yarn 26 entirely of multifilament yarn.

The method can further include knitting the yarn 26 including monofilament yarn.

Obviously, many modifications and variations of the present invention are possible in light of the above teachings. It is contemplated that all features of all claims and of all embodiments can be combined with each other, so long as such combinations would not contradict one another. It is, therefore, to be understood that within the scope of the appended claims, the invention may be practiced otherwise than as specifically described.

What is claimed is:

1. A convolute protective textile sleeve, comprising:

a flexible, tubular wall of knit yarn extending lengthwise along a longitudinal axis between opposite ends, said knit yarn including a plurality of courses extending circumferentially about said longitudinal axis and a plurality of wales extending lengthwise from one of said opposite ends to the other of said opposite ends in generally parallel relation with said longitudinal axis, said plurality of courses including a plurality of first courses forming annular crests of said tubular wall having a first diameter and a plurality of second courses forming annular valleys of said tubular wall having a second diameter less than said first diameter, said first courses and said second courses alternating with one another along said longitudinal axis to provide said tubular wall with a convolute contour, wherein said first courses are formed of front knit stitches and said second courses are formed of back knit stitches.

2. The convolute protective sleeve of claim 1, wherein an axially extending length of each annular crest is provided by controlling the number of successive axially adjacent interlinked front knit stitches within said first courses and an axially extending length of each annular valley is provided by controlling the number of successive axially adjacent interlinked back knit stitches within said second courses.

3. The convolute protective sleeve of claim 1, wherein said wall is circumferentially continuous and seamless.

4. The convolute protective sleeve of claim 1, wherein said wall has opposite lengthwise extending edges extending generally parallel to said longitudinal axis, said edges being configured to be wrapped into overlapping relation with one another.

5. The convolute protective sleeve of claim 4, wherein at least some of said knit yarn includes heat-set yarn biasing and maintaining said opposite edges in wrapped, overlapping relation with one another.

6. The convolute protective sleeve of claim 1, wherein said knit yarn includes monofilament yarn.

7. The convolute protective sleeve of claim 6, wherein said annular valleys are formed entirely of said monofilament yarn.

8. The convolute protective sleeve of claim 7, wherein said knit yarn includes multifilament yarn.

9. The convolute protective sleeve of claim 8, wherein said annular peaks are formed entirely of said multifilament yarn.

10. The convolute protective sleeve of claim 6, wherein said knit yarn includes multifilament yarn.

11. The convolute protective sleeve of claim 10, wherein said annular peaks are formed entirely of said multifilament yarn.

12. The convolute protective sleeve of claim 1, wherein said knit yarn is entirely multifilament yarn.

13. A method of constructing a convolute textile sleeve, comprising:

knitting yarn to form a flexible wall including a plurality of wales extending generally parallel to a longitudinal axis between opposite ends of the flexible wall and a plurality of courses extending generally transverse to the longitudinal axis;

knitting the plurality of courses including first courses forming annular crests and second courses forming annular valleys alternating with one another along the longitudinal axis; and knitting the first courses as annular front knit stitches and knitting the second courses as back knit stitches.

14. The method of claim 13, further including knitting the flexible wall as a circumferentially continuous, seamless wall.

15. The method of claim 13, further including knitting the flexible wall having opposite edges extending lengthwise between the opposite ends, with the opposite edges being configured to overlap one another.

16. The method of claim 15, further including heat-setting the flexible wall to impart a bias on the wall to automatically bias the opposite edges into overlapping relation with one another.

17. The method of claim 13, further including controlling the axially extending length of individual ones of the annular crests by controlling the number of successive axially adjacent interlinked front knit stitches within the first courses and controlling the axially extending length individual ones of the annular valleys by controlling the number of successive axially adjacent interlinked back knit stitches within the second courses.

18. The method of claim 17, further including knitting the annular valleys entirely with multifilament yarn.

19. The method of claim 18, further including knitting the annular peaks entirely with monofilament yarn.

20. The method of claim 13, further including knitting the yarn entirely of multifilament yarn.

* * * * *